United States Patent [19]

Nuzzi et al.

[11] 4,199,623

[45] Apr. 22, 1980

[54] PROCESS FOR SENSITIZING ARTICLES FOR METALLIZATION AND RESULTING ARTICLES

[75] Inventors: Francis J. Nuzzi, Freeport; Edward J. Leech, Oyster Bay; Richard W. Charm, Huntington Station; Joseph Polichette, South Farmingdale, all of N.Y.

[73] Assignee: Kollmorgen Technologies Corporation, Dallas, Tex.

[21] Appl. No.: 796,809

[22] Filed: May 13, 1977

Related U.S. Application Data

[63] Continuation of Ser. No. 520,355, Nov. 1, 1974, abandoned, which is a continuation-in-part of Ser. No. 270,861, Jul. 11, 1972, and a continuation-in-part of Ser. No. 407,555, Oct. 18, 1973.

[51] Int. Cl.[2] ..... B05D 3/10

[52] U.S. Cl. ..... 427/305; 106/1.11; 427/304; 427/306; 427/343; 427/404; 427/443.1

[58] Field of Search ..... 427/304–306, 427/437, 438, 430 A, 404, 343; 204/30; 106/1

[56] References Cited

U.S. PATENT DOCUMENTS

| | | | |
|---|---|---|---|
| 2,472,393 | 6/1949 | Avallone | 427/305 |
| 3,075,855 | 1/1963 | Agens | 427/305 |
| 3,524,754 | 8/1970 | Blytas | 427/305 |
| 3,561,995 | 2/1971 | Wu et al. | 427/304 |
| 3,617,340 | 11/1971 | Thielen | 427/305 |
| 3,620,822 | 11/1971 | Oei | 427/305 |
| 3,672,938 | 6/1972 | Zeblisky | 427/306 |
| 3,748,166 | 7/1973 | Kadison et al. | 427/404 |
| 3,764,352 | 10/1973 | Gulla | 106/1 |
| 3,772,078 | 11/1973 | Polichette et al. | 427/404 |
| 3,959,547 | 5/1976 | Polichette et al. | 427/305 |

*Primary Examiner*—Ronald H. Smith
*Assistant Examiner*—Janyce A. Bell

[57] ABSTRACT

Surfaces of articles are sensitized for the deposition of adherent metal from electroless metal solutions in contact therewith by prior treatment with an activatable complex of copper in a liquid medium formed from a solution comprising a mixture of halogen, cuprous and cupric components and thereafter forming a deposit on the treated article surfaces of a water-insoluble derivative of the said complex. Such surface deposits are treated with a reducing agent or water to enhance their reception of metal in an electroless metal deposition bath.

45 Claims, No Drawings

PROCESS FOR SENSITIZING ARTICLES FOR METALLIZATION AND RESULTING ARTICLES

This is a continuation of application Ser. No. 520,355 filed Nov. 1, 1974 now abandoned, which in turn is a continuation-in-part of copending applications Ser. No. 270,861, filed July 11, 1972 and Ser. No. 407,555, filed Oct. 18, 1973.

This invention relates to processes for pre-sensitizing and sensitizing articles to the deposition of metals from solutions thereof and resultant articles. More particularly, it relates to improved means for providing adherent metal layers on articles by treating the surface of such articles so as to form catalytically active elements or precursors of same for contact with electroless metal deposition solutions.

Sensitizing substrates to the deposition of electroless metal, e.g., Group IB and VIII metals, i.e., copper, cobalt, nickel, gold, silver, and the like, is a key step in the production of decorative and industrially useful metallized objects, such as name plates, dials, printed circuits, and the like. This sensitization is conventionally carried out by treating the substrate either stepwise with a solution of stannous tin or similar ions, followed by contacting with a solution containing precious metal ions, such as palladium or platinum, or all in one step with a unitary colloidal suspension of precious metal or with a soluble complex of precious metal ion, stannous ion and an anion. These processes yield a sensitive surface which when immersed in a conventional electroless metal deposition bath causes metal to deposit on all of the sensitized areas thereof.

A number of proposals have been made to carry out such processes more economically and efficiently:

Chiecchi, U.S. Pat. No. 3,379,556 discloses immersion in a beta-resorcylato chromic chloride solution to eliminate pretreatments such as sealing, sandblasting, etching, and the like. This method still requires the use of a two-step, stannous-palladium subsequent treatment. See, for example, Schneble et al, U.S. Pat. No. 3,403,035 and U.S. Pat. No. 3,033,703. Moreover, the chromium complexes are difficult to prepare, stabilize and use. In addition, the complex must be polymerized after application and before subsequent treatment steps.

Bernhardt et al, U.S. Pat. No. 3,547,784, disclose treating a non-metallic surface with stannous salt then with a silver salt and then electrolessly plating using processes and deposition baths for copper, nickel and silver found, for example, in Schneble et al, U.S. Pat. Nos. 3,527,215 and 3,347,724. The Bernhardt et al process is conventional and the point of novelty resides in using a particular copolymer of vinyl chloride, which was not easy to metallize up until the time of the invention.

In a more recent development, there have been provided so-called metal reduction sensitizers, which can employ base metal ions, followed by treatment with reducing solutions or radiant energy, e.g., heat, light, and the like, to produce the sensitized surface.

The metal reduction sensitizing process consists of coating a surface, preferably one which has been activated in known ways to render it permanently polarized and wettable, or microporous, with a reducible metal salt solution, e.g., $CuSO_4.5H_2O$, $NiSO_4.6H_2O$, and the like, then either draining, semi-drying or completely drying the so-treated surface. Sensitization is then completed by immersing the surface in a strongly reducing medium, e.g., a sodium borohydride solution, during which step the metal salts are reduced to elemental metal particles. This sensitized surface is then rinsed and electrolessly plated.

Due to the solubility of these reducible metal salts, surfaces contacted therewith cannot be rinsed without removing all of the salts from the surface. And when the surfaces are not rinsed, the drag-over of excess metal salts into the reducing medium shortens its life and turns it black with atomic metal particles.

If a means could be provided to rinse excess and unwanted metal salts from the surface before immersion in the reducing medium, the above-noted problems would be avoided. In addition, control would be facilitated because rinsing would provide a positive indication that the only remaining materials are those elemental particles which are adsorbed by the surface and which are necessary for subsequent catalytic activity.

"Inorganic Reactions And Structures" by Edwin S. Gould, Henry Holt & Co., New York, New York, 1955, at page 165, mentions transient phenomena wherein the reduction of copper (II) halides to copper (I) halides may be carried out by means of copper metal in a concentrated hydrochloric acid solution, with the liquid taking on an "intermediate black color" before fading to the colorless $CuCl_2^-$ ion. Gould theorizes that the black color is probably due to dimeric or polymeric ions having copper in both the +1 and +2 states, e.g., $[Cl—Cu—Cl—CuCl_2(H_2O)]^-$. This publication does not disclose or suggest any utility for Gould's unstable material, any manner of stabilizing it, or any definite quantitative relation of $Cu^+$ and $Cu^{++}$ for yielding same.

According to the present invention, improvements are disclosed for rendering surfaces sensitive to electroless metal deposition. The disclosed sensitizing process uses copper and its compounds and yet yields results comparable to the use of conventional, expensive, and somewhat unstable sensitizers based entirely on precious metals.

In comparison with the prior art techniques, the instant system provides the following distinct advantages:

(i) more complete rinsing of the treated substrate can now be tolerated because of tremendously improved adsorption of the copper complex in the seeder medium on the substrate surface and insolubilization thereon;

(ii) the "take" or coverage in the electroless metal bath is wholly uniform and rapid; and (iii) in the case of activated substrates, metallization within the surface micropores is deep and complete, thereby enhancing strength of the bond between deposited metal and substrate.

According to the present invention, there are provided processes for pre-sensitizing and sensitizing surfaces of articles for the subsequent deposition of adherent metal from an electroless metal deposition solution in contact therewith, said processes including the step of treating the surface or selected areas of the surface of said article with a liquid seeder medium comprising an activatable complex containing copper, thereby adsorbing said complex on said surface in situ. The adsorbed copper-containing complex is then rendered water-insoluble.

Certain embodiments of the novel processes also involve treating the water-insoluble derivative with one or more activating agents such as reducing agents or water, either simultaneously with or subsequent to the insolubilization step, to enhance the conversion of the deposit into a state which is more active to the deposition of electroless metal.

Still other process modifications relate to a process combination wherein such treatments are followed by an electroless metal deposition step.

Other aspects of the invention as well as its nature, objects and advantages will be apparent to those skilled in the art upon consideration of the detailed disclosure hereinafter.

The present method involves pre-sensitizing a substrate surface by adsorption thereon of a copper-containing complex in a liquid seeder medium. The adsorbed material is then rendered into a water-insoluble deposit on that surface.

Sensitizing liquid media according to the invention may be formed by, for example, admixing a polar liquid such as water, a source of copper, such as copper salt, elemental copper, copper oxide, and the like, or mixtures thereof, a source of halogen, and, optionally and preferably, a source of hydrogen ions.

Although the active seeding components resulting from initially forming solutions according to this disclosure are herein designated as "complexes," and we believe that they are in fact complexes, their exact nature and composition is unclear. Specific references to these characteristics are included as our best collective judgement as to what actually occurs, and results, when the procedures we describe are practiced.

In the process, liquid seeders formed from solutions according to the invention are believed to include an activatable copper complex. The activatable complex of copper in a liquid medium is brought into intimate contact with a substrate, preferably by immersion in the medium for a period which may be exemplified as about 5 to 10 minutes at room temperature or elevated temperatures. This activatable complex often has an essentially dark or even black appearance and is formed from a solution including moieties of copper in both its +1 and +2 valence states. The complex may be of a polymeric nature. The composition of the liquid seeder forming solutions is described in detail hereinafter, and it appears that the complex formed therefrom is strongly adsorbed on the substrate surface.

The actual composition of complexes according to the invention is not known. As further described below, useful complexes are obtained by forming solutions comprising a halogen component, a cuprous component and a cupric component. It is believed that complexes according to the invention contain at least two copper atoms, and that these atoms have at least two different oxidation numbers selected from the group consisting of 0, 1 and 2. It is further believed that these complexes contain at least one halogen atom. As also described in greater detail infra, solutions yielding copper-containing complexes according to the invention preferably contain cuprous/cupric copper atoms in the weight ratio of at least 0.4 to 1.

The above-described complex is than rendered into a water-insoluble derivative. The preferred method is to expose the treated substrate, while it is still wet with the sensitizing liquid, to a quantity of an aqueous medium sufficient to precipitate the adsorbed material as a water-insoluble derivative of the complex and also to wash off any excess solution that was not adsorbed on the surfaces of the substrate. This deposit is in the form of an adherent layer on the surfaces of the substrate that were exposed to the seeder solution. Its insolubilization, or precipitation as a water-insoluble derivative of the said copper complex in this fashion, is believed to be the result of a hydrolysis reaction.

If, for example, the insolubilization agent comprises water or dilute sulfuric acid, the initial precipitate formed on the treated surface during the water treatment is believed to include copper salts, and indeed may consist essentially of copper salts. At the point at which the sensitizer-treated surface first is provided with an insoluble deposit; the surface may be considered to be pre-sensitized and essentially not yet catalytic to electroless metal deposition. We say essentially because, as described in detail below, we are dealing with a continuum of relative catalytic activity which, although generally controllable, prohibits flat statements with respect to the existence of no catalytic activity whatever.

In any event, if insolubilization of the copper complex is accomplished via treatment of the substrate with water, and this water treatment is halted immediately upon the formation of an adherent precipitate coating on the substrate, a pre-sensitized substrate results. The article may then be dried and stored for later sensitization as described infra, which may be followed by metallization in electroless metal deposition baths, or it may be immediately further processed.

If, rather than halting water-treatment upon the formation of the adherent pre-sensitizing material, one continues the water treatment, the substrate is transformed over a continuum from a pre-sensitized substrate to a sensitized substrate that is catalytic to electroless metal deposition. We believe this result to be attributable to the disproportionation. of copper atoms having oxidation numbers other than zero to form copper atoms in the elemental state, i.e., having an oxidation number of zero, and the resultant formation of microcatalytic sites on the substrate surface. This change from pre-sensitized surface to sensitized surface may be observed on a macro scale after about one-half to a full minute's treatment with water, since it is usually accompanied by the pre-sensitized surface turning green as it assumes a sensitized or catalytically-active state.

Alternatively, the pre-sensitized substrate may be reduced to render it sensitized, for example by treating with a reducing agent following insolubilization.

Whether the sensitization of the pre-sensitized substrate is accomplished via disproportionation or reduction, the sensitized article may be set aside and stored for later adherent metallization in electroless metal deposition processes.

Still another alternative to the above-described sensitization process is to catalyze the pre-sensitized substrate in the electroless metal deposition bath, for example by incorporating a suitable reducing agent therein. Practice of this method avoids the requirement of conducting a separate and distinct catalyzing step in the process while still enabling ultimate catalyzation and electroless metal deposition.

The present seeder compositions comprise liquid media containing activatable complexes prepared from solutions containing both monovalent and divalent copper. With aqueous media, the complex-containing liquids are generally dark to black, with amber hues apparent at lower concentrations (e.g., a total dissolved Cu content of about 20 grams per liter or less). The quantity of dissolved copper in these solutions is not critical, and it may range from a barely effective concentration to large proportions that are restricted only by solubility characteristics or economic considerations. For illlustration, the total dissolved copper content of the solutions may range from about 0.5 to 30% by weight or more, and concentrations of about 5 to 15% are preferred.

The atomic ratio (weight ratio) of monovalent copper to divalent copper in the original solution is significant, as better yields and deposits of the complex are obtainable with an increase in that ratio, at least in the lower part of the range which may extend from about 0.4:1 to a ratio of 30:1 or more. Ratios of about 0.7:1 to about 20:1 appear to be better for general use. The $Cu^{+}:Cu^{++}$ ratio may be adjusted to the chosen value by a number of methods to be described.

Other components may desirably be present in these sensitizing compositions, such as stabilizers and wetting agents.

The stabilizers preserve or stabilize the liquid seeder during routine use or storage over an extended period. Such stabilizers include elemental metals, such as cobalt, iron, aluminum, nickel and copper, which aid in maintaining desirable oxidation number ratios and equilibria among the various components. Amines and halides are also useful stabilizers. Such substances as hydrochloric acid and sodium or potassium chloride tend to prevent excessive oxidation of the monovalent copper component, particularly when elemental copper is also present. Generally, a large excess of halogen seems to be beneficial, and in addition to being provided as above, useful halogens may be provided by hydrofluoric, hydrobromic and hydriodic acids and their soluble salts. Other useful stabilizers include resorcinol and barium and cobalt halides, such as the chlorides.

For prolonged storage, it is recommended that the pH of the solution be maintained at about 3.5 or below with HCl or another halogen containing acid.

The liquid seeders of the present invention may be prepared by several different methods which are described in detail in the examples. Broadly, the preparatory methods encompass mixing or otherwise contacting, continuously or intermittently, starting materials that contain copper atoms having at least two different oxidation numbers until the said complex is formed. For the present purposes, those oxidation numbers include the zero state of uncombined copper metal as well as monovalent and divalent copper moieties.

One method involves oxidizing a cuprous compound (e.g., cuprous chloride) in an excess of a halogen acid (e.g., hydrochloric acid) until there is sufficient divalent copper for the formation of the liquid seeder medium.

A second process involves reducing some cupric halide in a halogen acid with metallic cobalt, nickel, iron, aluminum or copper present, preferably in the absence of air, until there is enough monovalent copper for formation of the liquid seeder or sensitizer.

A third preparatory method that is often preferred for better control of the ratio of monovalent copper to divalent copper is to add both cuprous and cupric components to a strong solution of a halogen acid in water.

In all three processes, the appearance of a black or dark amber color in the liquid usually indicates that the activatable complex of copper has been formed. The existence of useful concentrations of a complex in liquids according to the invention can be tested by the formation, upon contacting with, or addition to, water, of a precipitate. The preparation of the seeder liquids is usually carried out at room temperature but heating above about 40° C., and especially boiling, can substantially improve the stability of the seeder liquid in certain instances.

Preferably, the seeder medium also contains a surfactant or wetting agent which will seek and affix itself firmly to the surface being treated, e.g., by electrical attraction or other means. Preferably also, that medium or the next treating liquid comprises a wetting agent having a polarity which is opposite to the polarity of at least some of the surface sites of the article to be sensitized. Fluorinated hydrocarbons are the preferred wetting agents.

In a preferred feature of the process of this invention, the enhancing agent or agents following pre-sensitization may be reducing agents, such as borohydrides, amine boranes, hydrazine hydrate, formaldehyde and others. It has been found that alkali metal borohydride compositions are especially useful and may be stabilized by proper attention to pH. If the pH of an aqueous sodium borohydride solution, which is normally about 9.4 (this and other pH values herein are measured at 25° C.), is adjusted upward, e.g., to 12–12.7, by adding a pH adjustor, e.g., an alkali metal hydroxide, i.e., sodium hydroxide, or phosphate and the like, any tendency to decompose is minimized and the working life is extended remarkably. However, pH's of above about 13 should be avoided, because there is a tendency to reduce the desired enhancement characteristics. Enhancement occurs at a pH of below 9.4, but then stability of the borohydride solution tends to be impaired.

In one embodiment, a precursor of a sensitizing medium may be formed when a copper compound or mixture thereof is mixed with ammonia or amine to form a copper complex with ammonia or amine or a mixture thereof, and the desired proportions of monovalent and divalent copper are established as described hereinbefore. Not only are ammonia or amines in their own rights powerful wetting agents, but so are the formed ion complexes. It appears that these ion complexes behave much like quaternary ammonium complexes, e.g., cationically. Such positively charged (polar) ion complexes are adsorbed by negative surface sites on the article to be sensitized. However, the complexes of copper formed from halogen-containing solutions are usually preferred, e.g., those prepared with an excess of hydrochloric acid or a chloride salt.

The present invention may be used to sensitize a wide variety of substrates, including non-metallic, insulating substrates and metallic substrates.

Non-metallic substrates include glass, porcelain, cloth, paper, compressed wood, and resins, both thermoplastic and thermosetting, and mixtures thereof.

Among the thermoplastic resins may be mentioned the acetal resins; acrylics, such as methyl acrylate; cellulosic resins, such as ethyl cellulose, cellulose acetate, cellulose propionate, cellulose acetate butyrate, cellulose nitrate and the like; chlorinated polyethers; nylon; polyethylene; polypropylene; polystyrene; styrene blends, such as acrylonitrile styrene copolymer and acrylonitrile-butadiene-styrene copolymers; polycarbonates; polyphenyloxide; polysulfones; polychlorotrifluoroethylene; and vinyl polymers and copolymers, such as vinyl acetate, vinyl alcohol, vinyl butyral, vinyl chloride, vinyl chlorideacetate copolymer, vinylidene chloride and vinyl formal.

Among the thermosetting resins may be mentioned allyl phthalate; furane; melamine-formaldehyde; phenol formaldehyde and phenol-furfural copolymer, alone or compounded with butadiene acrylonitrile copolymer or acrylonitrile-butadiene-styrene copolymers; polyacrylic esters; silicones; urea formaldehydes; epoxy resins; allyl resins, glyceryl phthalates and polyesters.

A preferred embodiment includes the use of a substrate having a surface made up of an adherent resinous layer, the layer having uniformly dispersed therein finely divided particles of oxidizable and degradable synthetic or natural rubber. Such bases are disclosed in U.S. Pat. No. 3,625,758.

The sensitization of metallic substrates is also possible with liquid seeder media according to the invention. Those skilled in the art are aware that it is sometimes desirable to catalyze elemental metal surfaces in order to build up further adherent metal deposits thereon in electroless metal deposition baths. Catalytic sites provided by substrates sensitized according to the invention may be useful in attaining such built-up metallization areas, whether the plating metal be the same or different than the original metal substrate.

One way to activate resinous bases is to render them permanently polar and wettable by treatment first with a preactivating agent, such as a strong organic solvent like dimethyl formamide, dimethyl sulfoxide, methyl ethyl ketone or a mixture of toluene and water, and so forth, depending on the nature of the resin, then with an activator such as chromic acid-sulfuric acid, and then with a reducing agent, such as sodium bisulfite or hydroxylamine hydrochloride, the result of which is to produce a permanently polarized, wettable surface.

Such techniques are disclosed in greater detail, for example, in copending U.S. patent application Ser. No. 227,678, filed Feb. 18, 1972, the disclosure of which is incorporated herein by reference.

On the other hand, the surface of the resinous article can be partially degradable, or be provided with a surface layer having such properties, or contain degradable particles, such as rubber particles, and on treatment with suitable agents, such as chromic acid or permanganate, be caused to become microporous and thus activated to adherent metal deposits. See, e.g., U.S. Pat. No. 3,625,758 to Stahl et al.

Any conventional electroless metal deposition bath useful with conventional precious metal sensitized surfaces can be used to deposit metal on the surfaces sensitized according to this invention. Generally, the deposition baths will contain an ion of the metal or metals whose deposition is desired, (e.g., copper, nickel, cobalt, silver, gold, and the like), a complexing agent for the ion, a reducing agent for the ion and an agent to adjust the bath to an optimum, predetermined pH. Such baths are amply described in the patent and textbook literature.

The following examples illustrate various forms of the invention.

EXAMPLE 1

The following redox mixture is prepared:

$CuCl_2.2H_2O$: 60 g.
CuCl: 35 g.
*Hydrochloric acid: 200 ml.
Water sufficient for: 1 liter
Copper metal sheet: 500 cm.$^2$

*All references to HCl in the examples are to 37% HCl in water.

The atomic or weight ratio of monovalent to divalent copper in the compounds charged here is 1:1 and the mixture is agitated in the presence of the copper metal in sheet form until the liquid becomes dark in a relatively short time, which is normally an indication of the formation of a coppercontaining complex which can be activated for catalyzing electroless deposition of metals.

EXAMPLE 2

An analogous redox composition is prepared using chemically equivalent quantities of cupric bromide, cuprous bromide and hydrobromic acid in place of the corresponding chlorine compounds in the formulation of Example 1. Agitation of this mixture also produces a complex of copper which can be activated as described herein for catalyzing electroless metal deposition.

EXAMPLE 3

Another redox formulation is compounded like that of Example 1 with chemically equivalent quantities of cupric iodide, cuprous iodide and hydriodic acid substituted for the corresponding chlorine compounds. Again, agitation of this mixture produces a complex that is adaptable for activation for catalyzing the deposition of metals by the electroless metal technique.

EXAMPLE 4

Still another composition analogous to that of Example 1 is mixed with chemically equivalent amounts of cupric fluoride, cuprous fluoride and hydrofluoric acid in lieu of the chlorine derivatives. Stirring this formulation produces a complex similar to that of Example 1 and is activatable for catalyzing substrates in a like manner.

EXAMPLE 5

Another redox formulation is prepared by heating the following composition to 40° C. with agitation until it becomes black.

CuCl: 100 g.
$CuCl_2.2H_2O$: 100 g.
HCl: 500 ml.
3-M surfactant FC-98: 0.5 g.
Water sufficient for: 1 liter
Copper metal sheet: 500 cm.$^2$ The atomic ratio of monovalent copper to divalent copper in the materials charged here is 1.72:1.

EXAMPLE 6

A different type of redox sensitizing solution is prepared according to the tabulation immediately hereinafter with resorcinol added as a stabilizing agent and with potassium chloride serving to provide the halogen.

CuCl: 50 g.
$CuCl_2.2H_2O$: 5 g.
Potassium Chloride: 100 g.
Resorcinol: 50 g.
Surfactant FC-98: 0.5 g.
Water sufficient for: 1 liter The order of adding these ingredients is of no significance. The atomic ratio of monovalent copper to divalent copper introduced into this composition is 17.2:1, much higher than before. Following development of a dark copper complex composition upon heating somewhat above 40° C., the composition is tested by adding a few drops to water and also by immersing a glass slide first in the treating composition and thereafter in water. In both instances, a precipitate is formed which is indicative of an activatable complex of copper. After three days of storage, these two tests are repeated with the same results thereby indicating that the treating composition has good storage stability. For considerably longer storage, it may be desirable to add enough hydrochloric acid to reduce the pH of the treating composition to 3.5 or lower.

EXAMPLE 7

A further embodiment of the resorcinol-stabilized seeder composition of the redox type is prepared by boiling the following components together for a relatively short time in forming the desired complex.

CuCl: 80 g.
$CuCl_2.2H_2O$: 200 g.
Resorcinol: 100 g.
HCl: 500 ml.
Surfactant FC-98: 0.5 g.
Water sufficient for: 1 liter The atomic ratio of the monovalent copper to divalent copper in the starting material of this composition is 0.69:1. This formulation is boiled during its preparation in order to eliminate an observed tendency to precipitate on cooling. Such heating also improves the storage stability of the composition over a period of at least three days by maintaining its efficiency as a seeding composition substantially higher than is possible with a corresponding composition that is not boiled. Other trials indicate that when the resorcinol is omitted from the formulation of this example, the resulting complex loses its effectiveness as an agent for catalyzing a glass slide for electroless metal deposition in less than three days even though the modified composition is boiled during its preparation.

EXAMPLE 8

In studying the effect of the ratio of monovalent copper to divalent copper in material introduced in preparing the copper complexes, the following substances are mixed together at room temperature until a dark composition is formed.

CuCl: 65 g.
$CuCl_2.2H_2$: 200 g.
HCl: 500 ml.
Water sufficient for: 1 liter
$Cu^+:Cu^{++}$ ratio: 0.56:1

No precipitate resulted from the dropwise addition of this solution to water. A more sensitive test was employed to verify the existence of an activatable copper complex. A clean glass slide was immersed in the solution for 1 minute and then submerged in water. The formation of some precipitate as a hazy coating on the surface of the slide indicated that the desired complex was present.

EXAMPLE 9

A solution is formed in exactly the same manner as in Example 8 except for increasing the amount of CuCl charged from 65 to 200 g. with a corresponding increase in the atomic ratio of monovalent copper to divalent copper to 1.72:1. The resulting product is a dark composition and it yields a heavy precipitate upon dropwise addition to water.

EXAMPLE 10

The procedure of Example 8 is again repeated with a composition which differs only in that the amount of CuCl charged is now increased from 65 to about 400 g., and this results in a solution saturated with that salt, for an estimated 100 g. of the cuprous salt remains undissolved even after thorough agitation of the mixture. The ratio of monovalent copper in solution to divalent copper therein is estimated to be about 2.6:1. Upon testing the resulting dark complex by adding it dropwise to water, a very thick precipitate is formed, considerably heavier than that of Example 9.

Upon comparing the results of Examples 8, 9 and 10, it is evident that a high atomic or weight ratio of monovalent copper to divalent copper is important in providing a high yield of the copper complex.

EXAMPLE 11

Other batches of the complex of Example 1 are prepared and the liquid is separated from the metallic copper; then barium chloride is added to the compositions in several amounts ranging from about 40 to about 200 g./l. It is found that this additive substantially increases the shelf life or stability in storage of the specimens of copper complex without affecting their activity. However, for prolonged storage, oxidation eventually occurs unless the composition is maintained in contact with metallic copper and there are periodic additions of hydrochloric acid and water to compensate for evaporation. Such oxidation is undesirable as it causes at least part of the copper complex to decompose with a consequent loss of the property of precipitating upon addition to water. There is reason to believe that the complex composition may be maintained in stable condition over an indefinite period if it is kept in a sealed container with copper metal present therein.

EXAMPLE 12

Example 11 is repeated with cobaltous chloride employed as a stabilizer in lieu of the barium chloride and in the same proportions. The results obtained with this cobalt compound are similar in providing improved storage stability without the loss of activity of the complex composition in the absence of metallic copper for a reasonable length of time, but prolonged storage requires measures along the lines suggested in Example 11.

EXAMPLE 13

In another method for preparing the copper complex by the oxidation of a reagent grade cuprous halide, the following substances are brought together:

CuCl (reagent grade): 70 g.
HCl: 200 ml.
Water sufficient for: 1 liter
Copper metal sheet: 500 $cm.^2$ This composition is heated at 40° to 45° C. and passed over the copper sheets until a dark complex forms.

Initially the composition is colorless but it eventually turns very dark over a period of several days, and reaches an equilibrium as long as the hydrochloric acid concentration and the presence of copper metal are maintained.

EXAMPLE 14

A composition having the components and proportions of Example 13 is oxidized by bubbling air through the solution in the presence of copper metal and a dark complex is formed more rapidly than before.

EXAMPLE 15

A further method of forming the said complexes of this invention involves essentially reduction in converting part of a divalent copper compound to a monovalent form by making up the following composition:

$CuCl_2.2H_2O$: 121 g.
HCl: 200 ml.

Water sufficient for: 1 liter
Copper chips: 30 g.

The above solution is agitated in the presence of the copper metal until a dark complex forms. This conversion occurs rapidly, especially when the composition is heated somewhat above 40° C.

EXAMPLE 16

The complex compositions of Examples 1 to 7 and 11 to 15 are each employed separately in treating a laminate for electroless copper deposition according to the following processing sequence.

1. A phenolic paper laminate coated with a rubber-phenolic resin adhesive is preliminarily treated by immersion for 15 minutes at 35° to 45° C. in a solution of the following composition:
$CrO_3$: 100 g.
$H_2SO_4$: 300 ml.
Surfactant FC-98: 0.5 g.
Water sufficient for: 1 liter
2. The substrate is neutralized in a bath containing 100 ml. of 85% hydrazine hydrate and 50 g. of sodium hydroxide per liter of water for 3 to 4 minutes.
3. The neutralized substrate is now rinsed in tap water for about 1.5 minutes.
4. Each laminate is now immersed in one of the complex seeder compositions of one of the aforesaid examples for a period from 10 to 15 minutes with constant and thorough agitation in the composition.
5. Upon removal from the seeder composition, each laminate is subjected to a rinse in running tap water for a period of about 45 to 75 seconds to convert the complex on the substrate to an adherent deposit of a water insoluble nature.
6. Next, the activity of the substrate is enhanced by reduction for 7 to 10 minutes in an alkaline sodium borohydride solution containing 1 g. of $NaBH_4$ and 2 ml. of 50% aqueous sodium hydroxide per liter of water ($pH \approx 12.3$).
7. Reduction is followed by a rinse for 5 minutes in water.
8. The sensitized substrate is then subjected to electroless copper plating by immersion for 30 to 45 minutes with thorough agitation in an electroless copper deposition bath of the formula:
$CuSO_4.5H_2O$: 30 g./l.
Rochelle Salts: 150 g./l.
Sodium Cyanide: 30 mg./l.
Formaldehyde (37% aqueous): 15 ml./l.
Wetting agent: 1 ml./l.
Sodium Hydroxide to Water to volume: pH 13

Electroless copper is deposited in a layer of the desired thickness on each of the substrates treated with the complexes of Examples 1 to 7 and 11 to 15. After thorough rinsing in water, each of these specimens dislays a good peel strength indicative of firm bonding of the electroless copper to the substrate.

EXAMPLE 17

In a somewhat similar procedure as that of Example 16, additional samples of the same adhesive-coated phenolic laminate are subjected to steps 1 to 5, inclusive, of Example 16, in the same manner as in the aforementioned process, with each laminate specimen being treated with a different complex seeder composition as before, but the subsequent processing is different and simpler than the previous steps designated as 6, 7 and 8. In the instant embodiment each laminate is immersed for 45 minutes in a simple solution of an electroless metal containing a strong reducing agent in the form of an amineborane. Such a reducing compound not only serves its usual function in the deposition bath but also substantially enhances the catalytic activity of the water-insoluble derivative coating on the laminate. In illustration of the deposition of another metal, nickel, the electroless metal solution has the following composition:
$NiSO_4.6H_2O$: 8 g.
Dimethylamine borane: 1.35 g.
Formaldehyde (37%): 2.5 ml.
Monoethanolamine: 40 ml.
2-mecaptobenzothiazole: 0.5 mg.
Water to make: 1000 ml.
pH: 12.5 ml.

After the customary washing in water, it is found that the electroless nickel is firmly bonded to all laminate specimens. Such surfaces may be plated up further with additional amounts of the same metal or with different metals, such as copper, cobalt, silver, gold and the like.

EXAMPLE 18

Another copper complex is prepared and stabilized by the reduction method with the following materials:
CuCl (technical grade)*: 80 g.
HCl: 300 ml.
Surfactant FC-98: 0.5 g.
Water sufficient for: 1 liter
Copper metal sheet: 500 $cm.^2$

* Contains a small proportion of cupric chloride.

When a dark complex appears, it is employed for treating two specimens, one being a clean glass slide and the other a laminate coated with an adhesive of the type mentioned hereinbefore and pretreated as described in steps 1 to 3 of the foregoing processing sequence. Each of these specimens is immersed for 5 minutes in the treating composition of this example while thorough agitation is maintained, then rinsed for 5 minutes in running water. Upon immersion of these specimens in a room temperature electroless copper deposition bath of the aforementioned composition while adequate agitation is maintained, it is observed that after 15 minutes in the bath, electroless copper begins to appear on the laminate, and the latter is 99% covered at the end of 1 hour.

This embodiment of the instant process is simpler in employing no reducing agent step following sensitizing.

EXAMPLE 19

In a preparation employing cobalt rather than copper in elemental form, the following constituents are stirred together until the liquid turns dark with the formation of a complex:
$CuCl_2.2H_2O$: 120 g.
HCl: 200 ml.
Cobalt metal dust: excess
Water sufficient for: 1 liter

EXAMPLE 20

A mixture of:
$CuCl_2.2H_2O$: 120 g.
HCl: 300 ml.
Iron dust: excess
Water sufficient for: 1 liter is stirred until a dark complex is formed, and an exotherm is observed during this procedure. Aluminum dust can be substituted with substantially the same results.

EXAMPLE 21

A mixture of metal salts is illustrated in the following composition which is shaken until a dark complex appears.

$CoCl_2.6H_2O$: 120 g.
$CuCl_2.2H_2O$: 120 g.
HCl: 200 ml.
Copper dust: excess
Water sufficient: 1 liter

EXAMPLE 22

A variation of the formulation in Example 19 is prepared with 120 g. of $NiCl_2.6H_2O$ substituted for the cobalt salt, and a dark complex is formed while the mixture is being shaken.

EXAMPLE 23

When carefully cleaned laminate samples are immersed separately in each of the compositions of Examples 18 to 22, and then rinsed in water, a water insoluble deposit is observed on the surfaces of each of the test laminates. Further processing of the treated laminate by reduction and electroless plating as described hereinbefore demonstrates the occurrence of substantial catalytic activation of the laminate surfaces.

EXAMPLE 24

The following solution was prepared at room temperature:

CuCl (technical grade): 200 g.
HCl: 550 ml.
FC-98: 0.1 g.
Water sufficient for: 1 liter
Copper metal sheet: 250 $cm^2$ Epoxy/glass laminates coated with a rubber-base resinous adhesive (Beiersdorf Technicoll 801) were rendered hydrophilic in a chrome/sulfuric activating solution comprising 100 grams/liter $CrO_3$ and 350 milliliters/liter 98% sulfuric acid and immersed in a liquid seeding medium formed from the above solution, with all other preceding and subsequent steps and conditions being according to Example 16. The seeding and metallizing process was carried out until the seeding liquid's strength had been reduced enough to result in sporadic electroless copper plating on the substrate surface. It was determined that one gallon of the seeder liquid of this example was capable of seeding about 300 square feet of substrate of the sort described without replenishment of the seeder liquid in any way, including additional CuCl or elemental copper.

While the present invention has been described in full detail in respect to a limited number of examples for the purposes of complete disclosure, it will be appreciated by those skilled in the art that many other modifications and embodiments fall within the purview of this invention.

We claim:

1. In the process for the electroless deposition of metal on a non-metallic surface, the improvement which comprises presensitizing the non-metallic surface to the electroless deposition of metal by a method which comprises:

(a) contacting said non-metallic surface with an activatable copper complex in a liquid medium containing cuprous ions and cupric ions in a weight ratio of cuprous ions to cupric ions not less than 0.4:1, said medium resulting from the admixture of a polar liquid, an acid, a halogen-containing compound, a cuprous compound, and absorbing on said surface a derivative from said liquid medium, (b) rinsing said contacted surface with said derivative thereon with an aqueous medium to remove the excess of said medium from said surface and to water-insolubilize said derivative adsorbed on said non-metallic surface, (c) after said surface has been rinsed and the excess of said medium has been removed from said surface, treating the water-insolubilized derivative on said sensitized surface with a reducing agent to render the surface catalytically active to electroless deposition of metal.

2. A process according to claim 1, wherein said polar liquid is water.

3. A process according to claim 2, wherein said halogen-containing compound is chlorine.

4. A process according to claim 1, wherein said medium is in at least intermittent contact with an elemental metal.

5. A process according to claim 4, wherein said elemental metal is selected from the group consisting of copper, cobalt, iron, aluminum and nickel.

6. A process according to claim 1, wherein said aqueous rinsing medium is water.

7. A process according to claim 1 including the further step of rendering said water-insolublized adsorbed derivative on said surface catalytically active to the deposition of electroless metal and electrolessly depositing metal thereon by simultaneously contacting said surface with a reducing agent to reduce said derivative and with an electroless metal deposition solution.

8. A process according to claim 1, including the further step of metallizing said catalytically active surface in an electroless metal deposition bath and electrolessly depositing metal thereon.

9. A process according to claim 1, wherein said reducing agent is selected from the group consisting of borohydrides, amine boranes and hydrazine hydrate.

10. A process according to claim 8, wherein said water-insolublized adsorbed derivative is rendered catalytically active and said catalytically active surface is metallized in an electroless metal deposition bath containing a reducing agent.

11. A process according to claim 10 including the further step of treating said water-insolublized adsorbed derivative on said sensitizable surface with a reducing agent selected from the group consisting of borohydrides, amine boranes and hydrazine hydrate to render said surface catalytically active to electroless metal deposition.

12. A process according to claim 1, wherein said liquid medium is aqueous and acidic.

13. A process according to claim 12, wherein said halogen is chlorine.

14. A process according to claim 1, wherein the weight ratio of cuprous ions to cupric ions is at least about 0.7 to 1.

15. A process according to claim 1, wherein said ratio is from about 0.4 to 1 to about 30 to 1.

16. A process according to claim 14, wherein said ratio is from about 0.7 to 1 to about 20 to 1.

17. A process according to claim 15 wherein said liquid medium contains a stabilizer for maintaining said weight ratio.

18. A process according to claim 17, wherein said stabilizer is selected from the group consisting of resorcinol, barium ions, and cobalt ions.

19. A process according to claim 14, wherein said liquid medium also contains a wetting agent.

20. A process according to claim 19 wherein said wetting agent is a fluorinated hydrocarbon.

21. In a process for the electroless deposition of metal on a non-metallic surface, the improvement which comprises pre-sensitizing the non-metallic surface to the electroless deposition of metal by a method which comprises:

(a) contacting said non-metallic surface with an activatable copper complex in a liquid medium containing cupric ions and cuprous ions in a weight ratio of cuprous ions to cupric ions not substantially less than 0.4:1 and not substantially more than 30:1, said medium resulting from the admixture of a polar liquid medium, a halogen-containing compound, a cupric compound, and a cuprous compound, and adsorbing on said surface a derivative therefrom.

(b) rinsing said contacted surface with said derivative thereon with water to rinse the excess of said medium from said surface and to water-insolublize said derivative adsorbed on said non-metallic surface, and (c) treating said water-insolublized adsorbed derivative on said sensitizable surface with a reducing agent selected from the group consisting of borohydrides, amine boranes and hydrazine hydrate to render said surface catalytically active to electroless metal deposition.

22. A process according to claim 21, wherein said liquid medium is in at least intermittent contact with an elemental metal.

23. A process according to claim 22, wherein said elemental metal is selected from the group consisting of copper, cobalt, iron, aluminum and nickel.

24. A process according to claim 23 wherein said elemental metal is copper.

25. In a process for the electroless deposition of metal on a non-metallic surface, the improvement which comprises sensitizing the non-metallic surface to the electroless deposition of metal by a method comprising the steps of:

(a) contacting said non-metallic surface with an activatable copper complex in a liquid medium containing cuprous ions and cupric ions in a weight ratio of cuprous ions to cupric ions not substantially less than 0.4:1 and not substantially more than 30:1, said medium resulting from the admixture of a polar liquid, a halogen-containing compound, a cupric compound, and a cuprous compound and absorbing on said surface a derivative from said medium;

(b) rinsing said contacted surface with an aqueous solution to water-insolublize the adsorbed derivative on said surface and to remove from said surface the excess of said medium; and (c) treating said rinsed surface with a reducing agent to render said water-insolublized adsorbed derivative catalytic to the electroless deposition of metal.

26. A process according to claim 25, wherein said polar liquid is aqueous and said halogen is chlorine.

27. A process according to claim 26, wherein said aqueous rinsing solution is water.

28. A process according to claim 25, wherein said reducing agent is a hydride.

29. A process according to claim 28, wherein said hydride is borohydride or borane.

30. A process according to claim 25, wherein said liquid medium is in at least intermittent contact with an elemental metal.

31. A process according to claim 30, wherein said elemental metal is selected from the group consisting of copper, cobalt, iron, aluminum and nickel.

32. A process according to claim 30, wherein said elemental metal is copper.

33. A process according to claim 25, wherein the combined weight of said cupric and cuprous compounds in said liquid medium is not substantially less than 0.5% and not substantially more than 30% and the weight ratio of cuprous ions to cupric ions is at least about 0.4 to 1.

34. A process according to claim 33, wherein said ratio of cuprous ions to cupric ions is from about 0.4 to 1 to about 30 to 1.

35. A process according to claim 25, wherein the combined weight and said cupric and cuprous compounds in said liquid medium is not substantially less than 5% and not substantially more than 15% and the ratio of cuprous ions to cupric ions from about 0.7 to 1 to about 20 to 1.

36. A process according to claim 25, wherein said liquid medium also contains a stabilizer.

37. A process according to claim 36, wherein said stabilizer is selected from the group consisting of resorcinol, barium ions, and cobalt ions.

38. A process according to claim 36, wherein said solution also contains a wetting agent.

39. A process according to claim 38, wherein said wetting agent is a fluorinated hydrocarbon.

40. A process for the electroless deposition of metal on a non-metallic surface, said process comprising the steps of:

(a) pre-sensitizing the non-metallic surface to the electroless deposition of metal by contacting said non-metallic surface with an activatable copper complex in a liquid medium formed from an admixture of a polar liquid, a halide, cupric ions and cuprous ions in a weight ratio of cuprous ions to cupric ions of at least 0.4 to 1;

(b) rinsing said contacted surface with an aqueous solution and forming an adherent water-insoluble derivative of said liquid medium adsorbed on said non-metallic surface;

(c) treating said rinsed surface with a reducing agent to render said insoluble derivative catalytic to the electroless deposition of metal; and (d) contacting said catalytically sensitive surface with an electroless metal deposition bath to form an electroless deposit of metal thereon.

41. A process according to claim 40, where steps (c) and (d) are carried out simultaneously by contacting said rinsed surface with reducing agent-containing electroless metal deposition bath.

42. A process according to claim 40 wherein said reducing agent includes at least one member selected from the group consisting of borohydrides, amine boranes and hydrazine hydrate.

43. A process according to claim 40, wherein said liquid medium also contains a stabilizer.

44. A process according to claim 43 wherein said liquid medium also contains a wetting agent.

45. In the process for the electroless deposition of metal on a non-metallic surface, the improvement which comprises pre-sensitizing the non-metallic surface to the electroless deposition of metal by a method which comprises:

(a) contacting said non-metallic surface with an activatable copper complex in a liquid medium containing cuprous ions and cupric ions in a weight ratio of cuprous ions to cupric ions of at least 0.4:1, said medium resulting from the admixture of a polar liquid, an acid, a halogen-containing compound and a cuprous compound, and adsorbing on said surface a derivative from said liquid medium;

(b) rinsing said contacted surface with said derivative thereon with water to remove the excess of said medium from said surface and to water-insolubilize said derivative adsorbed on said non-metallic surface; and (c) prolonging said water treatment to sensitize said surface to the electroless deposition of metal.

* * * * *